US007942578B2

(12) United States Patent
Andersen

(10) Patent No.: US 7,942,578 B2
(45) Date of Patent: May 17, 2011

(54) CONTAINER

(75) Inventor: Kent Andersen, Koebenhavn V (DK)

(73) Assignee: Coloplast A/S, Humlebaek (DK)

( * ) Notice: Subject to any disclaimer, the term of this patent is extended or adjusted under 35 U.S.C. 154(b) by 888 days.

(21) Appl. No.: 10/544,835

(22) PCT Filed: Feb. 3, 2004

(86) PCT No.: PCT/DK2004/000076

§ 371 (c)(1),
(2), (4) Date: May 22, 2006

(87) PCT Pub. No.: WO2004/069682

PCT Pub. Date: Aug. 19, 2004

(65) Prior Publication Data

US 2006/0257057 A1 Nov. 16, 2006

(30) Foreign Application Priority Data

Feb. 7, 2003 (DK) ..... 2003 00170
Apr. 11, 2003 (DK) ..... 2003 00580

(51) Int. Cl.
*B65D 30/16* (2006.01)
*B65D 33/10* (2006.01)
*B65D 33/06* (2006.01)
*B65D 30/22* (2006.01)
*B65D 33/16* (2006.01)

(52) U.S. Cl. ..... 383/104; 383/10; 383/16; 383/39; 383/66

(58) Field of Classification Search ..... 383/66, 383/10, 907, 38, 3, 901, 39, 37, 104; 604/340, 604/327, 317; 206/522; 215/11.6
See application file for complete search history.

(56) References Cited

U.S. PATENT DOCUMENTS

| | | | | | |
|---|---|---|---|---|---|
| 2,462,215 | A | * | 2/1949 | Norman et al. | 5/644 |
| 2,651,302 | A | * | 9/1953 | Berry | 602/13 |
| 2,651,314 | A | * | 9/1953 | Hasselquist | 52/2.19 |
| 3,164,152 | A | * | 1/1965 | Vere Nicoll | 602/13 |
| 3,223,310 | A | * | 12/1965 | Becker et al. | 206/466 |
| 3,540,170 | A | * | 11/1970 | Flowers | 52/2.19 |
| 3,721,243 | A | * | 3/1973 | Hesterman | 604/67 |
| 3,815,646 | A | * | 6/1974 | Coakley | 141/337 |
| 4,157,713 | A | * | 6/1979 | Clarey | 602/13 |
| 4,442,834 | A | * | 4/1984 | Tucker et al. | 602/13 |
| 4,574,953 | A | * | 3/1986 | Garbuzov | 206/522 |
| 4,705,085 | A | * | 11/1987 | Brown | 220/592.16 |
| 4,793,123 | A | * | 12/1988 | Pharo | 53/449 |
| 4,886,373 | A | | 12/1989 | Corella | |
| 4,890,757 | A | | 1/1990 | Robbins, III | |

(Continued)

FOREIGN PATENT DOCUMENTS

EP 0 283 447 A2 9/1988

(Continued)

*Primary Examiner* — Jes F Pascua

(74) *Attorney, Agent, or Firm* — Coloplast Corp., Coloplat A/S; Daniel G. Chapik; Nicholas R. Baumann

(57) ABSTRACT

A container for comprising fluid, said container comprising a front wall and a rear wall of pliant material being sealed together along the edge portion to produce a closed bag having a top portion (6) and a bottom portion (5) connected by two side portions (3, 4), wherein the side portions of the edge of the bag may be superimposed and when sealed together forms a three-dimensional configuration. The container may be self-supporting and stable.

10 Claims, 2 Drawing Sheets

U.S. PATENT DOCUMENTS

| | | | | | |
|---|---|---|---|---|---|
| 4,941,754 | A | * | 7/1990 | Murdock | 383/3 |
| 4,951,940 | A | * | 8/1990 | Vitello et al. | 482/105 |
| 4,955,879 | A | * | 9/1990 | Mervine | 604/327 |
| 5,050,870 | A | * | 9/1991 | Pollock | 482/105 |
| 5,178,281 | A | * | 1/1993 | Enzu | 206/522 |
| 5,454,642 | A | | 10/1995 | De Luca | |
| 5,509,229 | A | * | 4/1996 | Thomasson et al. | 47/29.2 |
| 5,692,833 | A | * | 12/1997 | DeLuca | 383/3 |
| 5,833,069 | A | * | 11/1998 | Jones | 206/522 |
| 6,108,970 | A | * | 8/2000 | Ball | 47/48.5 |
| 6,123,217 | A | * | 9/2000 | Miller | 220/592.19 |
| 6,282,835 | B1 | * | 9/2001 | Richtsmeier | 47/24.1 |
| 6,409,385 | B1 | | 6/2002 | Gee | |
| 6,629,777 | B2 | * | 10/2003 | Tanaka et al. | 383/3 |
| 2001/0037872 | A1 | | 11/2001 | Sabin et al. | |
| 2002/0186900 | A1 | | 12/2002 | Horne | |
| 2003/0062286 | A1 | * | 4/2003 | Igarashi | 206/522 |

FOREIGN PATENT DOCUMENTS

| | | | |
|---|---|---|---|
| EP | 0 452 167 | A1 | 10/1991 |
| EP | 0 802 121 | A1 | 10/1997 |
| FR | 2 585 678 | | 2/1987 |
| GB | 2 336 830 | A | 11/1999 |
| WO | WO 02/100737 | A1 | 12/2002 |

* cited by examiner

CONTAINER

This is a nationalization of PCT/DK2004/000076 filed 3 Feb. 2004 and published in English.

BACKGROUND OF THE INVENTION

1. Field of the Invention

The invention relates to a container for liquid or fluid material. The container is flexible and may be collapsible when empty.

2. Description of the Related Art

Flexible containers for storing, transporting, delivering or collecting fluids are well known, e.g. from the food industry, fuel containers or the medical field. The containers may be collapsible when empty, thus saving place or decreasing the volume of waste. In the medical field the containers may be useful for many purposes such as collecting urine or delivering flushing liquid for irrigation.

It may be preferred that the container is self-supporting and stable, so the risk of tilting is low. Furthermore it should be easy to handle and to fill and empty the container. In order to achieve the self-supporting properties, the bag may have a tree-dimensional structure. However, producing such three-dimensional structures may often be complicated and expensive.

Containers may be exposed to pressure and should be sturdy enough to handle this without the risk of bursts or leakage. Containers for various purposes are known:

U.S. Pat. No. 4,890,757 discloses a self-supporting container comprising side-walls of thin, non-self-supporting material, reinforced with a plurality of laterally spaced, rigid ribs. The bag is not collapsible.

In FR Patent Application No. 2 585 678 is disclosed a flexible container for liquids. The container has foldable side-walls with stiffening pleats to allow compact storage and an inlet. The container has a rectangular flat bottom, and is collapsible when empty. The container has to be made of a rather stiff material in order to keep shape and stability when filled with liquid.

There are many different usages for flexible, self-supporting containers in the medical field, e.g. for the home and hospital nursing in connection with the collection of body fluids and for the insertion of fluids into the body. Examples of collection may be exudates, urine or faecal matters. Examples of insertion may be intravenous, flushing of bladder, rectal enema or medication.

For insertion into the body a certain pressure is necessary. This pressure is usually achieved by hanging the container above the patient. To ensure a safe hanging, different types of racks and tripods—often on wheels—are seen everywhere in hospitals. However it is often difficult for the patient, who may be confined to a wheelchair or bed, to hang the container above him.

From GB Patent Application No. 2 336 830 is disclosed a drainage bag of pyramid configuration. The shape of the bag allows it to be stabilized by the weight of its contents. The bag is provided with an inlet and an outlet, located in the seam adjacent the corners of the bag. The pyramid configuration offers good stability but the location of the in- and outlets in the seam may give rise to leakage problems, as well as the bag is complicated to produce, due to the three-dimensional structure. Furthermore, the bag will be inflated to a more round configuration when it is exposed to pressure, and is thus less able to stand safely by itself.

Thus, it is an object of the invention to provide a flexible, self-supporting container for fluids, being sturdy and stable.

Another object of the invention is to provide a flexible container, which can easily and safely be pressurised.

Yet another object of the invention is to provide a collapsible container, which can be folded to take up as little space as possible.

It has now been found that the container of the present invention fulfils the above-mentioned demands.

SUMMARY OF THE INVENTION

The invention relates to a container for comprising fluid, said container comprising a front wall and a rear wall of pliant material being sealed together along the edge portion to produce a closed bag having a top portion and a bottom portion connected by two side portions.

Furthermore, the invention relates to a process for producing a container for comprising fluid.

BRIEF DESCRIPTION OF THE DRAWINGS

The invention is disclosed more in detail with reference to the drawings in which.

DETAILED DESCRIPTION OF THE PRESENT INVENTION

Figure 1:
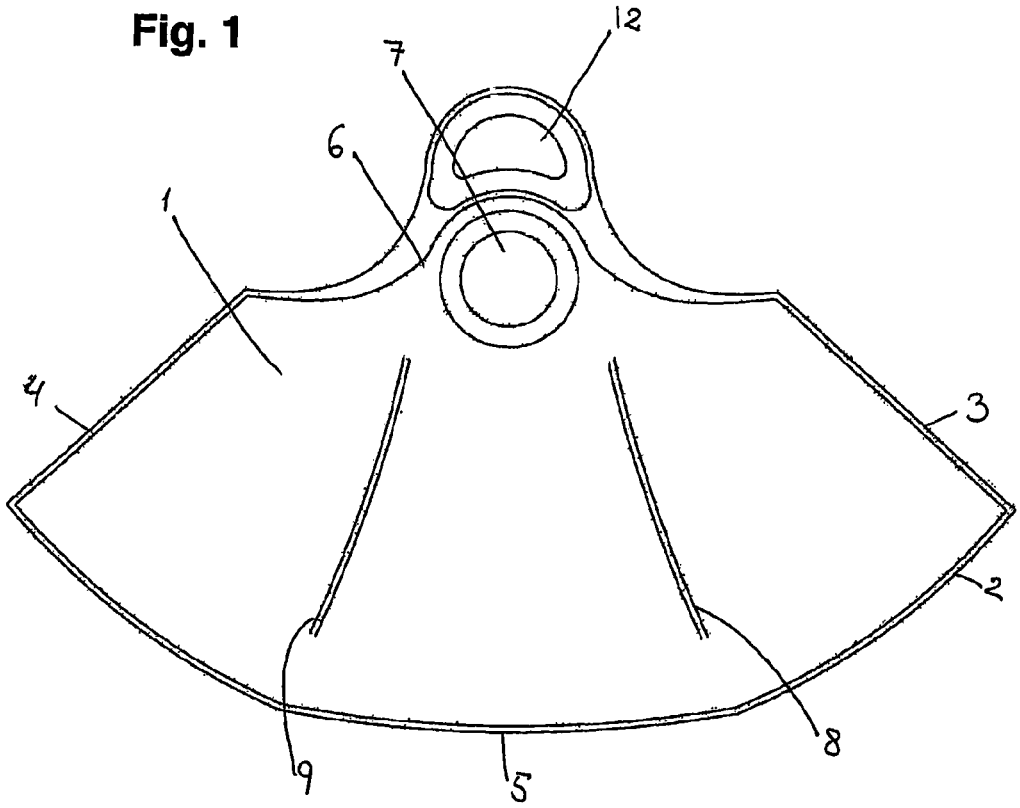
FIG. 1 shows a preferred embodiment of a container of the invention in a flat position.

The present invention relates to a container for comprising fluid, said container comprising a front wall and a rear wall of pliant material being sealed together along the edge portion to produce a closed bag having a top portion and a bottom portion connected by two side portions, wherein the side portions of the edge of the bag may be superimposed and when sealed together forms a three-dimensional configuration.

The container is preferably self-supporting (FIG. 4) without the need for a stand as it may be stabilised by the weight of its content. The container rests on the bottom edge portion 5, defining a tetrahedral, rectangle, polygon or circular configuration. As the container mainly rests on the bottom edge portion 5, a high stability is achieved, even when the container is pressurize. Containers having a flat bottom surface often round like a balloon when inflated.

In a preferred embodiment of the invention the side portions diverge from the top portion towards the bottom portion.

In another embodiment of the invention the side edge portions of the closed bag may be substantially parallel.

The edge portions of the container may be linear or curvilinear.

Due to the shape and the flexible properties the container is easy to fill or empty, as it easily passes under a water tub or into a sink/toilet.

The container is easily collapsible when empty, ad thus does not take up place for the user when not is use and reduces the volume of waste when discarded.

The container comprises pliant material, being flexible and bendable enough for folding and practical storage, but not with too much elastic elongation or plastic deformation as the container then may deform when filled or pressurised and thus decrease the stability.

Suitable materials for the production of the container of the invention may be polymer films, such as laminates or metallic foils or metallic laminates. Suitable materials for production of the container of the invention may be films such as multilayer film, commonly used in the food industry for vacuum packed ham, sausage or spices. An especially suitable film may be a multilayer foil from Wipak comprising the components of PA/EVOH/PA/adhesive/PE/PE.

Due to the configuration of the container of the present invention, the stability is high, even when the container only contains low levels of fluid. Many of the well-known self-supporting containers become wobbly and unstable in this situation.

It is preferred that the front wall and the rear wall are sealed together with at least one longitudinal seam, said seam being separate from the edge portions.

The longitudinal seam may be linear or curvilinear and may be in the form of a continuous seam or it may be in the form of an array of discrete seams.

The longitudinal seam may be substantially perpendicular to the bottom portion.

Preferably the container of the invention comprises two longitudinal seams.

The longitudinal seams may distribute the pressure on the seams of the container, thus decreasing the risk of leakage due to overload of the seams. Furthermore, the longitudinal seams may serve as anti-splash means when the container is transported. Finally the longitudinal seams may serve as guidelines for folding the container into the three-dimensional configuration.

Instead of using gravity for obtaining the desired pressure when delivering liquids, the container may be pressurised by pumping gas into it. However, this often requires a lot of pumping, as well as has high demands to the joints and weldings of the bag.

When pressurising a simple squared bag or a round bag filled with a fluid, usually one third or more of the bag volume is filled with the pressurizing gas before a useful pressure is build up. The configuration of the present invention has the advantage that only 10-15% of the volume has to be filled, before the bag has reached its final shape and a useful pressure is being build. Thus, less pumping is demanded, which may be important if the person operating the pumping means suffers from reduced dexterity.

The present invention solves this problem of establishing a pressure in the bag in a different way by pressurising the bag with a simple pump, thus enabling us to leave the bag on the floor or elsewhere instead of being dependent on establishing pressure due to gravity e.g. by hanging the container above the patient.

The container may be especially suitable for use for performing enema or stomal irrigation or doing bladder flushing or for the installation of medication.

Figure 3:
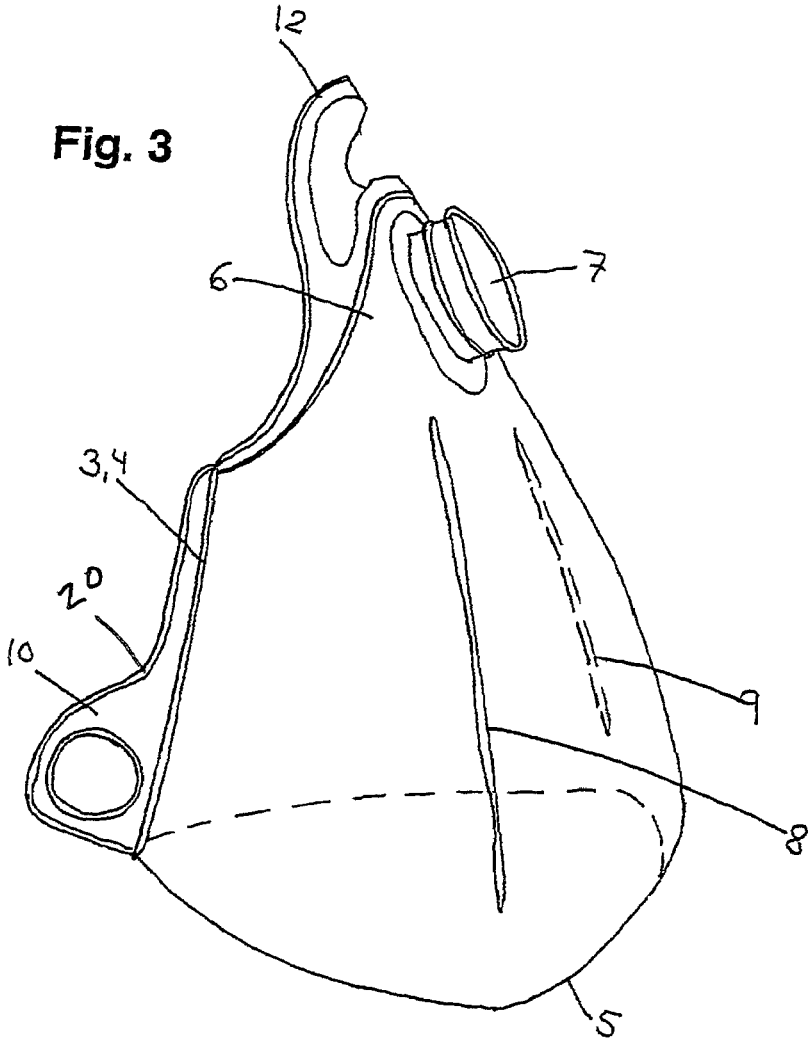
FIG. 3 shows the same embodiment in its final position.

The side portions may be unreleasably sealed to each other (at 20 in FIG. 3). The sealing may be provided by well-known means such as welding or adhesive means.

Figure 4:
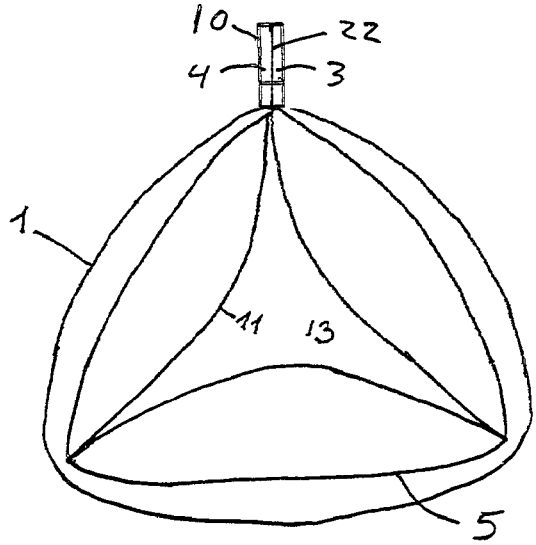
FIG. 4 shows the same embodiment seen from below.

In one embodiment of the invention the side portions are releasably sealed to each other e.g. by the use of buttons, the attachment mechanism sold under the trademark Velcro, adhesive or the like as illustrated at 22 in FIG. 4. This renders it possible to use the container in a flat, unfolded condition if desired. Furthermore, the container may be attached to a member, e.g. a leg or arm or part of a bed or wheelchair by wrapping the container around the member, and then sealing the side portions to each other. If the container is to be attached to a member is not essential that it is self-supporting as the attachment may stabilise the container.

In one embodiment of the invention the container may be a bag for collecting urine.

The container may be delivered to the user without the side portions being sealed; the user may then assemble the container into its three-dimensional configuration before or during use.

The container may be provided with one or more handles. The handles render it possible to transport or hang the container. The seams along the edge portions may be widened and/or prolonged to incorporate handles for transport, emptying or hanging, or separate handles may be attached to the container in a permanent or detachable way.

The container of the invention is provided with at least one in- or outlet.

The inlets and outlets of the bag may be placed at any suitable location of the bag. Commonly known containers have often placed these in the outer seam. In the container of the invention, the in- and outlets may be placed both in the seams but also outside the seams, reducing the risk of leakage as well as enhancing the flexibility during the production of the bag.

In a preferred embodiment of the invention the container is provided with an inlet in the front wall.

In- and outlets may be incorporated with tubing integrated in the welding of the film with a flange on the film surface. The in- or outlets may be of different size and shapes dependent on the intended use of the container. The container may e.g. be equipped with a spout for easy pouring from the container, or the container may have an outlet with a valve at the top or bottom portion for delivering or receiving liquid.

In one embodiment of the invention the container may be provided with an inlet or an outlet located in the edge portion of the bag.

The invention further relates to a process for producing a container for comprising fluid comprising the steps of:

a) Sealing a front wall and a rear wall of pliant material together along the edge portion to produce a closed bag having a top portion and a bottom portion connected by two side portions, b) Superimposing the edge portions of the side portions, Sealing the edge portions of the side portions together forming a three-dimensional configuration.

It is preferred that the container is self-supported when assembled into its three-dimensional configuration.

The production of the container of the invention is simple as all weldings are done in one plane as opposed to the commonly known containers where weldings has to be done perpendicular to each other and thus a three-dimensional structure has to be handled, rendering a more difficult or complicated production line.

The container of the present invention may be produced in any suitable size dependent on what use it is intended for, for industrial purposes it may be quite large, while in other uses such as merchandise or medical devices may prefer a more moderate size. The material used for the production of the container may be adapted to the size and purpose of the bag.

When used in the medical field, the container may be produced in any suitable size, e.g. 0.5-5.0 l, in a preferred embodiment of the invention where the bag is used for trans anal irrigation a desired volume may be 1.0-1.7 l, more preferred 1.5-1.7 l.

The container may be suitable for containing most fluids, such as liquid, gas or free flowable particles or mixtures thereof.

DESCRIPTION OF THE PREFERRED EMBODIMENTS

The invention is now explained more in detail with reference to the drawings showing preferred embodiments of the invention.

FIG. 1 shows a preferred embodiment of the invention in a flat position. The container comprises a front wall (1) overlying a rear wall being sealed together along the edge portions (2) to define a closed bag. The bag comprises side portions (3,4) and a bottom portion (5) and a top portion (6). In the top portion (6) of the front wall (1) is positioned an inlet (7) for entering fluid into or out of the container. The top portion (6) may further be provided with a handle (12). The bag is further provided with two longitudinal seams (8,9). The side portions (3,4) are diverging from the top portion (6) towards the bottom portion (5). The bottom portion (5) is curvilinear, comprising three lines in connection forming a curve. By curving the bottom portion (5) the container will be in optimal balance.

Figure 2:
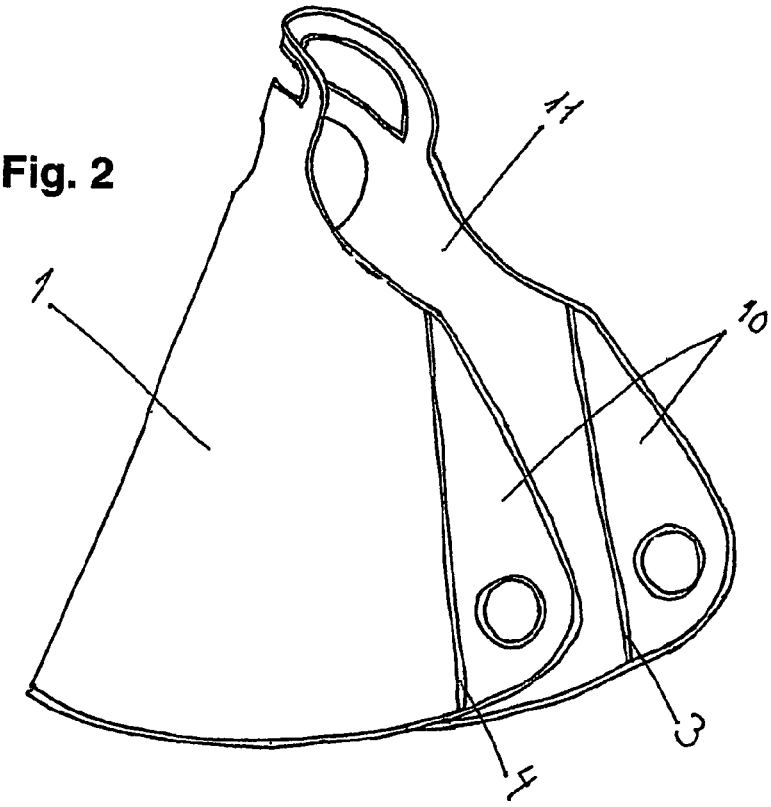
FIG. 2 shows an embodiment of the invention being prepared to be assembled to it final configuration.

Now referring to FIG. 2, the closed bag is folded with the front wall (1) out and the rear wall (2) inside to superimpose the side portions (3,4). In the shown embodiment the side portions (3,4) are extended into a handle portion (10). The side portions (3,4) are sealed to form a three-dimensional configuration as shown in FIG. 3.

In FIG. 3 is shown the container of FIG. 2 in assembled configuration. As can be seen the container rests on the bottom portion (5), which forms a substantially triangular configuration. The stability of the container is very high and it is difficult to tilt the bag.

In FIG. 4, the container is seen from below, in inflated or filled position. The front wall (1) defines an outer wall of the container, while the rear wall (1 1) defines an inner wall of the container. This double wall construction offers stability to the container, and distributes the pressure so the container, when inflated does not alter into a balloon shape. The side portions (3,4) are sealed at the handle (10). The container may be attached to a member (not shown), such as a leg by entering the leg into to the central cavity (13) of the container. The container may be unsealed at the side portions (3,4) during the attachment.

The invention claimed is:

1. A container comprising:

a front wall and a rear wall sealed together around their entire edge perimeters to form a bag having one interior compartment configured to contain liquid;

a seam bonding a portion of the front wall to a portion of the rear wall while permitting fluid communication between portions of the one interior compartment adjacent each side of the seam;

the sealed entire edge perimeter of the bag including an upper edge and a lower edge and first and second side edges, the one interior compartment extending between the first and second side edges;

a first side handle portion extending from the first side edge and a second side handle portion extending from the second side edge and the first and second side handle portions attachable together to locate the first side edge adjacent to the second side edge and configure the container to stand on the sealed lower edge of the bag with a base circumference that is larger than a circumference of the container where the first and second side edges intersect the upper edge; and an opening formed in one of the walls proximate the upper edge to define a passageway into the one interior compartment.

2. A container according to claim 1 wherein the seam comprises a longitudinal seam bonding a portion of the front wall to a portion of the rear wall, and wherein the longitudinal seam is substantially perpendicular to the lower edge.

3. A container according to claim 2 wherein the container comprises two longitudinal seams.

4. A container according to claim 1 wherein the first and second side handle portions are permanently attached together.

5. A container according to claim 1 wherein the first and second side handle portions are releasably attached together.

6. A container according to claim 1 further comprising a second handle located adjacent to where the first and second side edges intersect the upper edge.

7. A container according to claim 1 further comprising a spout coupled with the opening.

8. The container of claim 1, comprising a pair of seams that each bond a portion of the front wall to a portion of the rear wall and are generally perpendicular to the lower edge so as to subdivide the one interior compartment into three generally equal chambers that are in fluid communication with one another.

9. The container of claim 1, wherein the upper edge includes an arch.

10. The container of claim 1, wherein each of the front wall and the rear wall have a geometry such that when in a planar configuration the first and second side edges are non-parallel and when the first and second side edges are attached, the first and second side edges are parallel.

* * * * *